US007891489B2

(12) United States Patent
Chappuis

(10) Patent No.: US 7,891,489 B2
(45) **Date of Patent: *Feb. 22, 2011**

(54) PATIENT CHECK SYSTEM

(75) Inventor: Ron Chappuis, Palatine, IL (US)

(73) Assignee: Sage Products, Inc., Cary, IL (US)

( * ) Notice: Subject to any disclaimer, the term of this patent is extended or adjusted under 35 U.S.C. 154(b) by 308 days.

This patent is subject to a terminal disclaimer.

(21) Appl. No.: 11/928,816

(22) Filed: Oct. 30, 2007

(65) Prior Publication Data

US 2008/0087565 A1 Apr. 17, 2008

Related U.S. Application Data

(63) Continuation-in-part of application No. 11/170,995, filed on Jun. 29, 2005.

(51) Int. Cl.
*B65D 83/08* (2006.01)

(52) U.S. Cl. ..... 206/459.5; 206/233; 206/494; 206/232

(58) Field of Classification Search ..... 206/494, 206/459.5, 233, 438, 440, 484, 812, 361, 206/362.2, 209, 209.1, 210, 232; 40/312
See application file for complete search history.

(56) References Cited

U.S. PATENT DOCUMENTS

| | | | | |
|---|---|---|---|---|
| 1,942,917 | A | 1/1934 | d'Este | |
| 2,387,217 | A | 10/1945 | Scott | |
| 2,652,149 | A | 9/1953 | O'Meara | |
| 3,428,103 | A | 2/1969 | Walsh | |
| 3,460,740 | A | 8/1969 | Hagen | |
| 3,563,371 | A * | 2/1971 | Heinz | 206/361 |
| 3,583,459 | A | 6/1971 | Nappe | |
| 3,846,158 | A | 11/1974 | Vasilyadis | |
| 3,906,129 | A | 9/1975 | Damois | |
| 3,952,867 | A * | 4/1976 | McCord | 206/229 |
| 3,960,745 | A | 6/1976 | Billany | |
| 4,114,224 | A | 9/1978 | Disko | |
| 4,128,954 | A * | 12/1978 | White | 40/310 |

(Continued)

FOREIGN PATENT DOCUMENTS

| | | |
|---|---|---|
| DE | 94228 A | 5/1972 |

(Continued)

OTHER PUBLICATIONS

Office Action issued by the Canadian Patent Office in Canadian Patent Application Serial No. 2,551,310 dated Apr. 11, 2008.

*Primary Examiner*—David T Fidel
(74) *Attorney, Agent, or Firm*—Banner & Witcoff, Ltd.

(57) ABSTRACT

A system for assisting in communication of the state of a patient's condition is disclosed. In an embodiment, a plastic container of washcloths includes two labels. The first label is mounted on the container and occludes an entry into the container. The second label also is mounted on the container via attachment to the first label. The second label includes a template that is mounted face down. In operation, the second label may be removed and observations regarding the patient's skin condition that are made during use of the washcloth can be marked on the template provided on the second label. The second label then may be communicated from one care provider to another care provider.

14 Claims, 8 Drawing Sheets

U.S. PATENT DOCUMENTS 4,185,754 A 1/1980 Julius
4,313,774 A 2/1982 Arthur
4,417,658 A 11/1983 Gardner
4,521,910 A 6/1985 Keppel
4,526,404 A * 7/1985 Vazquez ..... 283/79
4,530,129 A * 7/1985 Labick et al. ..... 15/184
4,550,831 A 11/1985 Whitford
4,552,269 A 11/1985 Chang
4,570,820 A 2/1986 Murphy
4,610,357 A 9/1986 Nakamura
4,679,693 A 7/1987 Forman
4,709,399 A 11/1987 Sanders
4,723,301 A 2/1988 Chang
4,755,064 A 7/1988 Weber
4,775,582 A 10/1988 Abba
4,840,270 A 6/1989 Caputo et al.
4,846,504 A * 7/1989 MacGregor et al. ..... 283/102
4,858,604 A 8/1989 Konishi
4,863,064 A 9/1989 Dailey, III
4,880,111 A * 11/1989 Bagwell et al. ..... 206/209.1
4,881,646 A 11/1989 Weber
4,931,201 A 6/1990 Julemont
4,948,585 A 8/1990 Schlein
4,951,815 A 8/1990 Ulbrich
5,046,609 A * 9/1991 Mangini et al. ..... 206/232
5,066,527 A 11/1991 Newell
5,068,061 A 11/1991 Knobel
5,094,770 A 3/1992 Sheridan et al.
5,265,960 A 11/1993 Shikler
5,352,155 A * 10/1994 Fahey ..... 462/25
5,361,936 A * 11/1994 Cook ..... 221/63
5,472,279 A 12/1995 Lin
5,512,199 A 4/1996 Khan
5,595,786 A 1/1997 McBride, Jr. et al.
5,677,028 A 10/1997 Ravella
5,688,394 A 11/1997 McBride, Jr. et al.
5,690,958 A 11/1997 McGrath
5,709,866 A 1/1998 Booras et al.
5,725,311 A * 3/1998 Ponsi et al. ..... 383/66
D394,605 S 5/1998 Skiba et al.
5,906,278 A 5/1999 Ponsi et al.
5,910,125 A 6/1999 Cummings
5,928,973 A 7/1999 Daniel
5,956,794 A * 9/1999 Skiba et al. ..... 15/104.93
6,026,822 A 2/2000 Skiba et al.
6,029,809 A 2/2000 Skiba et al.
6,058,636 A * 5/2000 Colkmire ..... 40/630
6,113,271 A * 9/2000 Scott et al. ..... 383/211
6,116,910 A * 9/2000 Green ..... 434/263
6,135,274 A * 10/2000 James ..... 206/209.1
6,164,441 A 12/2000 Guy et al.
6,238,213 B1 5/2001 Young et al.
6,309,105 B1 10/2001 Palumbo
6,420,006 B1 * 7/2002 Scott ..... 428/40.1
6,708,826 B1 3/2004 Ginsberg
6,746,743 B2 6/2004 Knoerzer
6,767,604 B2 7/2004 Muir, Jr. et al.
6,838,078 B2 1/2005 Wang
6,976,628 B2 * 12/2005 Krupa ..... 235/462.08
7,066,916 B2 6/2006 Keaty, Jr.
7,195,689 B2 * 3/2007 Adams et al. ..... 156/252
7,427,574 B2 9/2008 Allen
2003/0122370 A1 7/2003 Goddard
2003/0194425 A1 10/2003 Simon
2004/0073417 A1 * 4/2004 Rubbert et al. ..... 703/11
2004/0230168 A1 11/2004 Keaty, Jr.
2005/0037172 A1 2/2005 Adams et al.
2005/0087467 A1 4/2005 Dao
2006/0019571 A1 1/2006 Lange
2006/0079143 A1 4/2006 Phan
2006/0081486 A1 4/2006 Klein

FOREIGN PATENT DOCUMENTS

EP 0546369 6/1993
EP 0211773 6/2004
GB 2177677 1/1987
JP 0030993 3/1979
JP 0409229 A 2/1992
JP 2003020597 A 1/2003
JP 2004 159742 A 6/2004
JP 2005013309 A 1/2005
WO 00527767 3/2005

* cited by examiner

PATIENT CHECK SYSTEM

CROSS REFERENCE TO RELATED APPLICATIONS

This application is a continuation-in-part of U.S. application Ser. No. 11/170,995, filed Jun. 29, 2005.

FIELD OF THE INVENTION

An aspect of the present invention is directed towards a system for providing patient information, more specifically towards a system of providing feedback to care providers regarding a patient's physical condition in a universal manner.

BACKGROUND

The health care field is constantly undergoing change. Recently, these changes have included increases in responsibility from physician to the nurse and from the nurse to LPN's and non-licensed personnel. LPN's and non-licensed personnel increasingly are performing more complex tasks/interventions. For example, non-licensed personnel may now carry the primary responsibility for bathing patients and patient hygiene. Patient baths frequently are performed with pre-packaged disposable washcloths. A plastic package of disposable washcloths for use in bathing a patient may be purchased from Sage Products, Inc. Some examples of packages of disposable washcloths are disclosed in U.S. Pat. No. 6,029,809 to Skiba et al. and U.S. Pat. No. 5,906,278 to Ponsi et al., both of which are incorporated by reference in their entirety herein.

Recent healthcare initiatives such as the Institutes for Healthcare Improvement's (IHI) 'Protecting 5 Million Lives Campaign' have highlighted the importance of daily skin inspections. The IHI suggests that in ideal circumstances staff should incorporate a skin inspection into their work, every time they assess a patient. For example, the IHI's guidelines for preventing pressure ulcers propose that all levels of staff should be educated to inspect the skin any time they are assisting the patient, such as when bathing. Upon recognition of any change in skin integrity, caregivers are to notify staff so that appropriate interventions can be put in place. In addition, the Centers for Medicare and Medicaid Services ("CMS") recently recommended that skin assessments be performed on each patient on admission to rule out skin injury that was present upon admission to a facility. The CMS also has stated that skin ulcers are preventable and that treatments for skin ulcers developed during care for other issues will not be reimbursed as of October 2008.

The use of non-licensed personnel or other individuals in performing care such as patient cleansing has distanced the more trained medical professional from the patient during such care procedures. For example, while bathing the patient, a care provider is in an excellent position to observe the skin condition of the patient. A care provider such as a non-licensed personnel or other individual may not, however, be in a position to address or provide care for areas of concern observed on the patient's skin. In addition, the care provider may have obstacles in providing information regarding areas of concern to a second care provider such as a doctor or nurse. The first and second care providers may speak different languages, or the first care provider may not directly interact with a second care provider. It would be useful to provide something that can aid a first care provider in providing feedback or hand-off of information to a second care provider regarding observations noted while providing care to the patient. A product that can assist in the communication of the state of a patient's condition would be useful. Moreover, even where care is provided by nurses or doctors, additional systems to assist in the communication and hand-off of information regarding the patient's condition would be useful.

BRIEF SUMMARY OF THE INVENTION

In an aspect of the present invention, a container holding health care supplies is configured with a label having a template on a first side, the label mounted on the container with the template face down. The label may be removed and mounted on a patient's medical chart so as to provide feedback regarding observations made while using the health care supplies. The label may include a marketing graphic on a second side of the label and the marketing graphic may promote the use of the template on the first side of the label. The label may be used to assist in communication of the state of a patient's condition.

BRIEF DESCRIPTION OF THE DRAWINGS

Aspects of the present invention are illustrated by way of example and not limited in the accompanying figures in which like reference numerals indicate similar elements.

DETAILED DESCRIPTION OF THE INVENTION

Figure 1:
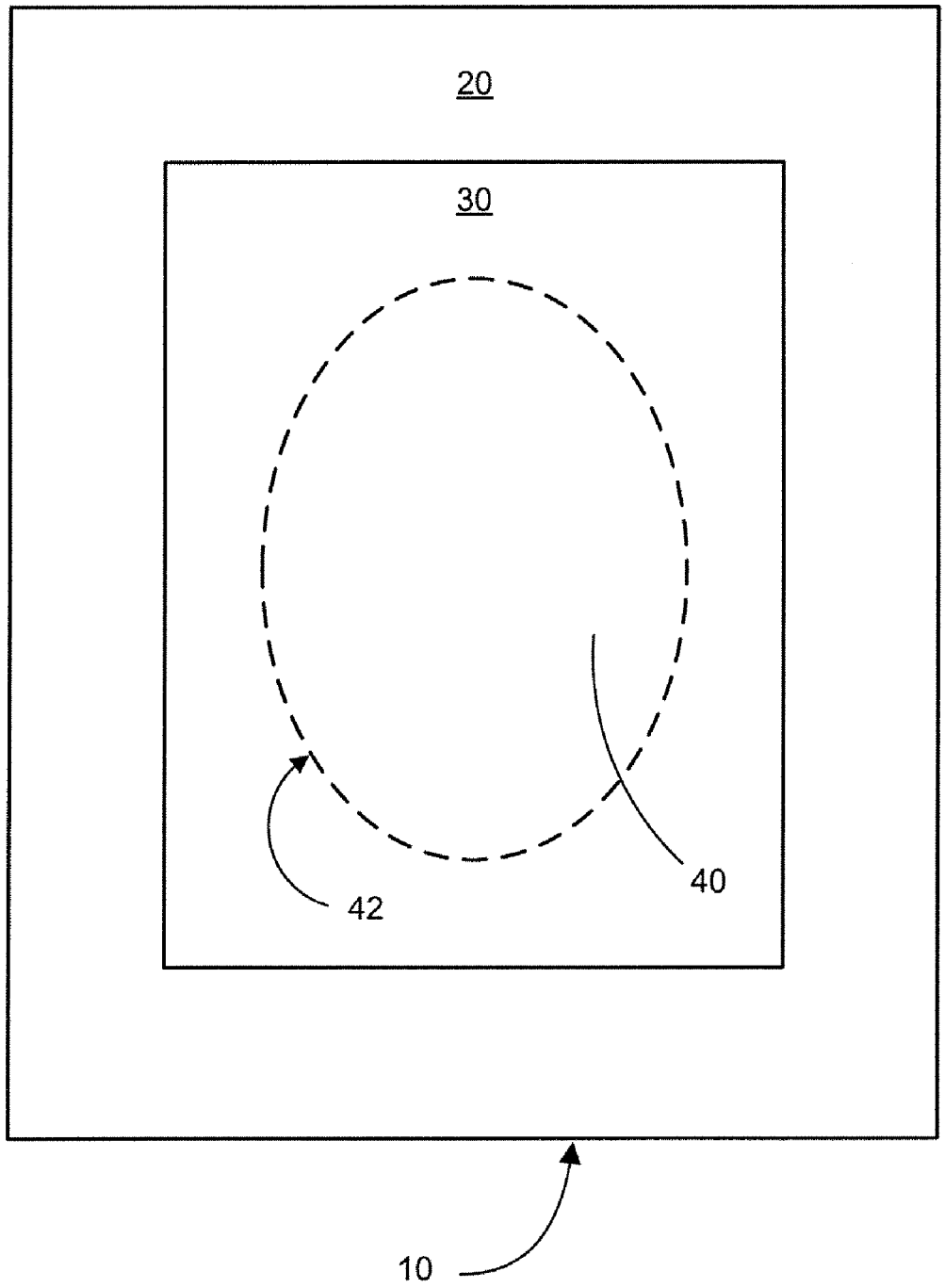
FIG. 1 illustrates an exemplary embodiment of a health care supplies assembly according to an aspect of the present invention.

Pre-packaged health care supplies are used by medical personnel for hygiene to clean and prepare patients in a variety of different settings ranging from preparation of a patient for surgery to bathing of the patient. In each case, the care provided by the medical personnel is extremely important to the well being of the patient. Thus, regardless of the complexity, the health care being provided is important to patient health.

In an embodiment of the present invention, a container includes health care supplies. The health care supplies may be provided in one or more compartments. The supplies may include non-woven patient bathing washcloths, oral care products such as a cleansing solution, toothbrush and suction device, oral cleansers such as swabs and an associated impregnating fluid, incontinence products, surgical preparation products, and other care products used with patients or individuals in hospitals or other care facilities. The term patient refers to any individual who receives care and is not limited to individuals admitted in a hospital setting. The container can be sealed. The container can include an edge, serration or crease or other entry that allows for the container to be opened through the application of a force. The container also can include an opening.

In an embodiment, a covering is placed over the opening or entry to the container. The covering can be removably mounted to the container. A care provider can remove the covering partially or fully and access the supplies within the container. The covering, in an embodiment, can then be reapplied to the container to reseal the opening or entry.

In an embodiment, a label is incorporated into the container. This label can be a card, ticket, tag, marker, sticker, sign or other piece of material. The label can include a template of a portion of a human anatomy. The template can depict all or a portion of the human body. In an exemplary embodiment, the template depicts at least a portion of the human mouth. In another exemplary embodiment, the template depicts discrete portions of the human body that are to be subject to care or a medical procedure, such as the ear, foot, scalp, back, front, abdomen, genital area, sacral/buttock area or perineal area.

In an embodiment, the label is removably mounted to the container of medical supplies. The label can be mounted to the container directly. The label also can be mounted to the container indirectly, such as by being mounted directly to the covering that is mounted directly to the container. The label can be mounted in several locations on the container, including on the front, back or side of the container. In another embodiment, the label is not mounted to the container but is included within the container.

In an embodiment, the label can contain a template on one side of the label. This template can be mounted to the container in such a manner that the template is face down. In such an embodiment, the template may not be visible from the other side of the label. The label also can include marketing material, including graphics or text, on the other side of the label. Instructions for use of the label optionally can be included on the side of the label with the template. The label, in an embodiment, can be removably mounted to the container with the marketing material face up and the marketing material can describe the template that is on the other side of the label. The marketing material, in an embodiment, can promote use of the template, can describe potential benefits of the template, and/or can describe use of the template. After the label is removed, it can be returned to the container, placed in another location such as a patient chart, handed-off to an additional care provider, or placed in a staging area for later recovery by a care provider. In an embodiment, the ability to view the template from only one side of the label allows for the information on the label to remain confidential when the label is placed face down, such as on a patient chart. In an alternate embodiment, the label can be removably mounted to the container with the template face up. The label also can contain marketing material describing or promoting use of the label on the other side of the label (mounted face down on the container). The template and the marketing material also can be on the same side or on both sides of the label.

In an embodiment, the label is incorporated into part of the covering of the container that extends beyond the edge of the opening or entry to the container. The label and covering form a continuous article. The label can be removed from the container and the remaining part of the covering without opening the container. The label is detachable from the remaining part of the covering by the application of force applied against perforations in the covering. Alternatively, other arrangements such as the use of serrations or creases in the covering can be employed to facilitate the removal of the label from the remaining part of the covering. In an embodiment, the care provider grasps the label and removes it from the remaining part of the covering by tearing the label away from the covering. In an alternative embodiment, the label is incorporated into part of the covering that does not extend beyond the edge of the entry to the container.

In an embodiment, a care provider removes the covering to the container and retrieves the medical supplies. The care provider then uses the supplies to provide care to a care recipient, such as a patient. In one example, the supplies are cleansers or cleansing substances such as washcloths that the care provider uses to cleanse all or a portion of the care recipient. While providing care to the care recipient, the care provider may observe a characteristic or condition of the care recipient's body. As an example, but without limitation, while providing a cleansing bath for the care recipient, the care provider may notice that the care recipient has a reddened area on his or her body. As a further example, while cleansing the care recipient's mouth, the care provider may notice that the care recipient has a compromised, tender or otherwise noteworthy area in their mouth.

In an embodiment, the care provider can use the label that is removably mounted to the container to record the area noticed or of concern. The care provider can place a marking on the template included in the label to denote the area of concern. The care provider can make a universal marking such as a circle or an "x" on the template and need not use words to make the marking. The care provider can then provide or otherwise communicate the label to a second care provider. The label can be directly handed to the second care provider. The label also can be placed on the care recipient's chart or can be placed in a staging area for later recovery by an additional care provider. The label can be used to communicate information regarding the state of the patient's condition from one health care provider to another. The label may allow for prevention of patient problems or allow for early intervention concerning patient problems. The label may serve as a reminder for the care provider to check the condition of the patient or a portion of the patient's body. Removal of the label also can provide an indication or notification that a patient check has been performed or that the patient check system has been activated. This indication can assist in determining whether rules or regulations requiring the assessment of the skin and/or of a patient have been met.

Turning to FIG. 1, an illustration of a health care supplies assembly 10 according to an aspect of the present invention is provided. The assembly 10 includes a container 20 with a label 30 mounted on the container 20. The label 30 can function as a covering for the container. The container 20 also includes an opening 40 (shown in dotted line) that is occluded by the label 30. While not shown, the container 20 includes health care supplies. For example, a container as disclosed in U.S. Pat. No. 6,029,809 to Skiba et al. or U.S. Pat. No. 5,906,278 to Ponsi et al., both of which are incorporated by reference in their entirety herein, may be used.

The health care supplies stored in the container 20 depend on the purpose of the assembly 10. In an exemplary embodiment, the health care supplies may be a plurality of washcloths (disposable or non-disposable) used to clean a portion of the patient. These washcloths can include woven materials, non-woven materials, preps, preparation materials for medical procedures, as well as products sometimes referred to as wipes, scrubs, or towels. The washcloths may include a cleanser, cleansing solution, and/or moisturizer that may include aloe and/or vitamin E.

Alternative health care supplies may be used with the supplies described above or by themselves. These supplies may include supplies useful in providing oral hygiene for a portion of the patient, such as a toothbrush, a suction toothbrush, swabs, suction swabs, yankauers (covered and uncovered), oropharyngeal suction catheters, cleansing solutions and/or pastes, solutions and/or pastes containing hydrogen peroxide, cetylpyridinium chloride, sodium bicarbonate and/or dentrifice, antiseptic oral rinses, mouthwash, mouth moisturizer, solutions containing vitamin E and/or coconut oil, gauze, swabs, sponges or wipes. These supplies also may include supplies that may be useful in providing incontinence care, such as washcloths, protective solutions, pastes and/or gels including solutions, pastes and/or gels containing dimethicone (in varying amounts, including 3% by weight dimethicone solutions) zinc oxide pastes and petroleum based gels and/or other protective products, rinse free cleansers, including cleansers containing aloe and/or vitamin E. These supplies also may include supplies useful in providing eye care and ear care, such as, cleansers, swabs, suction devices, cleansing solutions, microbial solutions, water brushes, and/or gauze. These supplies also may include supplies useful in providing foot care and/or heel care (such as the prevention or treatment of pressure ulcers on the heel), such as, boots and slippers (disposable and non-disposable), cleansing solutions, pastes and gels, moisturizers, and/or solutions containing vitamin E, aloe and/or coconut oil. These supplies also may include supplies useful in providing hair and/or scalp care, such as, caps, hats, washcloths, shampoos, conditioners (including rinse free shampoos and conditioners) and water. These supplies also may include supplies that may be useful in the preparation of a portion of the patient for surgery, such as, wands, swabs, brushes, sponges, washcloths, antiseptics, antibacterials, cleansing solutions, including solutions containing chlorohexidine and including solutions with 2% by weight chlorohexidine. These supplies also may include supplies that may be useful in obtaining blood cultures, such as wands, swabs, brushes, sponges, washcloths, antiseptics, antibacterials, cleansing solutions, syringes, and gauze. These supplies also include supplies that may be useful to medicate, manage, treat and prevent skin breakdown and infection in the body skin folds as well as supplies used for other care or medical procedures. Examples of some of these health care supplies include the materials disclosed in U.S. Pat. No. 5,709,866 to Booras, et al, U.S. Pat. No. 6,026,822 to Skiba, et al., and U.S. Pat. No. 6,238,213 to Young, et al., all three of which are incorporated by reference in their entirety herein. Other health care supplies will be apparent to one of ordinary skill in the art. The health care supplies may be used individually or in various combinations. The health care supplies may be in a container [not shown] other than container 20. The health care supplies also may not be in a container.

Thus, depending on the health care supplies stored within the container 20, the shape, size and material used to make the container 20 may vary. For example, if the health care supplies are a plurality of disposable washcloths then the container 20 may be made of a flexible plastic material.

As depicted, the container 20 includes the opening 40 that is occluded by the label 30. The shape of the opening 40 may vary depending on the health care supplies stored within the container 20. For example, if the health care supplies are the plurality of disposable washcloths then the opening 40 may be made as depicted or alternatively, the opening 40 may be more elongated or may resemble a slit and may be any other shape that allows the health care supplies to be removed from the container 20.

The shape of the label 30 is somewhat dependent on the shape of the opening 40 because, as depicted, the label 30 is configured to occlude the opening 40 and may also seal the container 20. However, as can be appreciated, the label 30 can be made to extend significantly beyond an edge 42 of the opening 40. In addition, depending on the size of the container 20 and the opening 40, additional labels may be provided.

It should be noted that the opening 40 may not be an actual opening when the label 30 is mounted to the container 20 but rather may be a potential opening. Therefore, the opening 40 may be an entry that may or may not be opened. Thus, the edge 42 may be an actual edge of the material used to form the container 20 or it may be a crease or serration in the material and may be configured to easily separate and form the opening 40 once the label 30 is removed.

Figure 2:
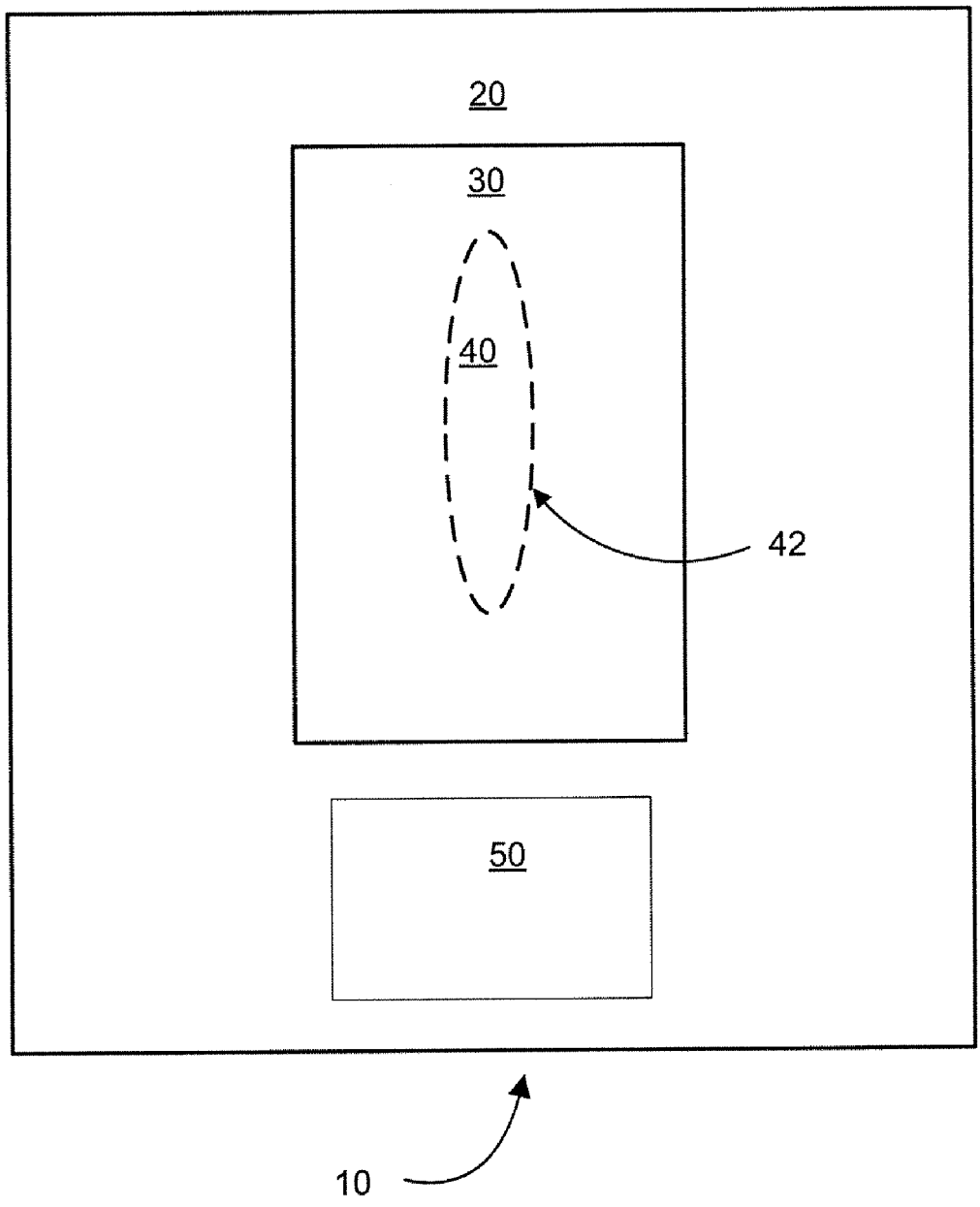
FIG. 2 illustrates an alternative exemplary embodiment of a health care supplies assembly according to an aspect of the present invention.

FIG. 2 illustrates an exemplary embodiment of the health care supplies assembly 10 with a second label 50 provided. As can be appreciated, the first label 30 is configured to cover the opening 40. Thus, the first label 30 may be a covering and may also seal the container 20. The second label 50 may provide other functionality that will be discussed below. Both labels may be removable mounted to the container 20, either directly or indirectly. For example, the second label 50 may be mounted directly to the container 20 or the second label 50 may be mounted to the container 20 indirectly by mounting the second label to a structure mounted to the container, such as the first label 30. In an embodiment, the first label 30 is mounted directly to the container 20 and the second label 50 is mounted indirectly to the container through attachment to the first label 30, and the second label 50 may be removed without opening the container 20. In another embodiment, the second label 50 is mounted directly to the container. The second label can be mounted in numerous positions on the container, including the front, side or rear of the container.

Figure 3:
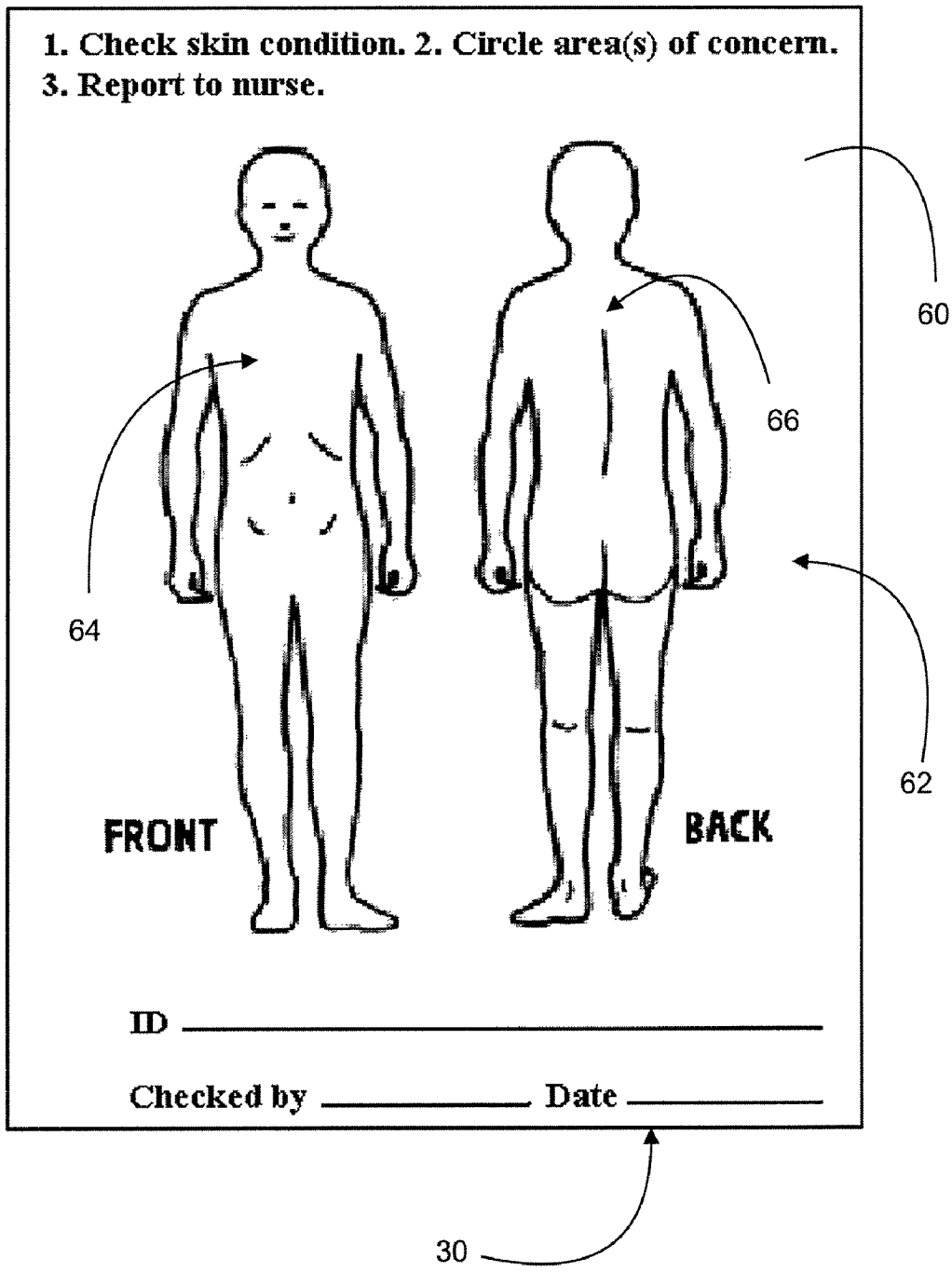
FIG. 3 illustrates an exemplary embodiment of a first side of a label according to an aspect of the present invention.

FIG. 3 illustrates an exemplary embodiment of a template 62 on a first side 60 of the label 30. It should also be noted that the second label 50, if provided, may include a first side similar to the first side 60 depicted in FIG. 3. It should be noted that the label 30 may omit the template 62 if the template 62 is included on the second label 50.

As depicted in FIG. 3, the template 62 is a representation of a patient and depicts a front 64 and a rear 66 of the patient. The label 30 may also include information on a second side 70, not shown, that will be discussed below. During use, a care provider may place a check mark, such as an "X" or a small circle, on the template 62 to indicate where a skin condition issue was noted. The label 30, including the marked up template, could then be placed on a patient's medical chart so that a second care provider could quickly review the template and know where to look to ascertain the skin condition of the patient. The label 30 also could be provided to an additional care provider, such as a nurse or doctor. The label 30 could be passed by hand to the additional care provider. The label 30 also could be placed at a location and remain there until retrieved by a care provider or other individual.

The label assists in communication among care providers and assists in the hand-off of information concerning the patient or subject. The label assists with communication of the state of the patient's condition. The label assists in preventing information about a patient from being lost. The label may be used as a tool to provide for passage of information from one care provider to one or several additional care providers. The hand-off of information can be direct or indirect. The label can assist in assuring that accurate information concerning a patient's condition is received by the appropriate care provider, rather than being lost or never recorded.

The information provided by the initial care provider need not be text or English. Through use of the label 30, care providers who do not speak a common language can transfer understandable information among themselves.

In another aspect, the care provider can input information concerning the patient's condition into a computer. While providing care to a patient the care provider may make observations concerning the patient's condition. The care provider can note this information on an electronic or computer related template or enter the information directly into a computer file.

For example, the container 20 may include a bar code, a RFID or other type of product indicia. A device that included a processor, such as a portable computing device, could be configured to read or scan the indicia so as to determine the type of product. Memory associated with the device would provide a list of one or more products that could be linked to one or more templates. In an embodiment, the processor could be coupled to a display so that the determination of the product would allow the processor to provide a template on the display. In an embodiment, the display, which could be touch sensitive, could be marked by the care provider so as to provide information regarding the an aspect of the physical condition of the patient.

While the template 62 is quite helpful, in some embodiments it is less desirable to display the template 62 on an exterior of the container 20 because the template 62 may not provide the appearance desired from a marketing standpoint. In addition, depending on the type of template 62, the shipping and storage of the assembly 10 may cause the template 62 to become damaged or otherwise marked up. In an embodiment the label 30 will be configured to be mounted on the container 20 with the template 62 face down. When the label 30 is configured to occlude the opening 40 and the label 30 also includes the template 62, the template 62 may be mounted face down so the template 62 is not visible until a portion of the label 30 is peeled away.

Figure 4:
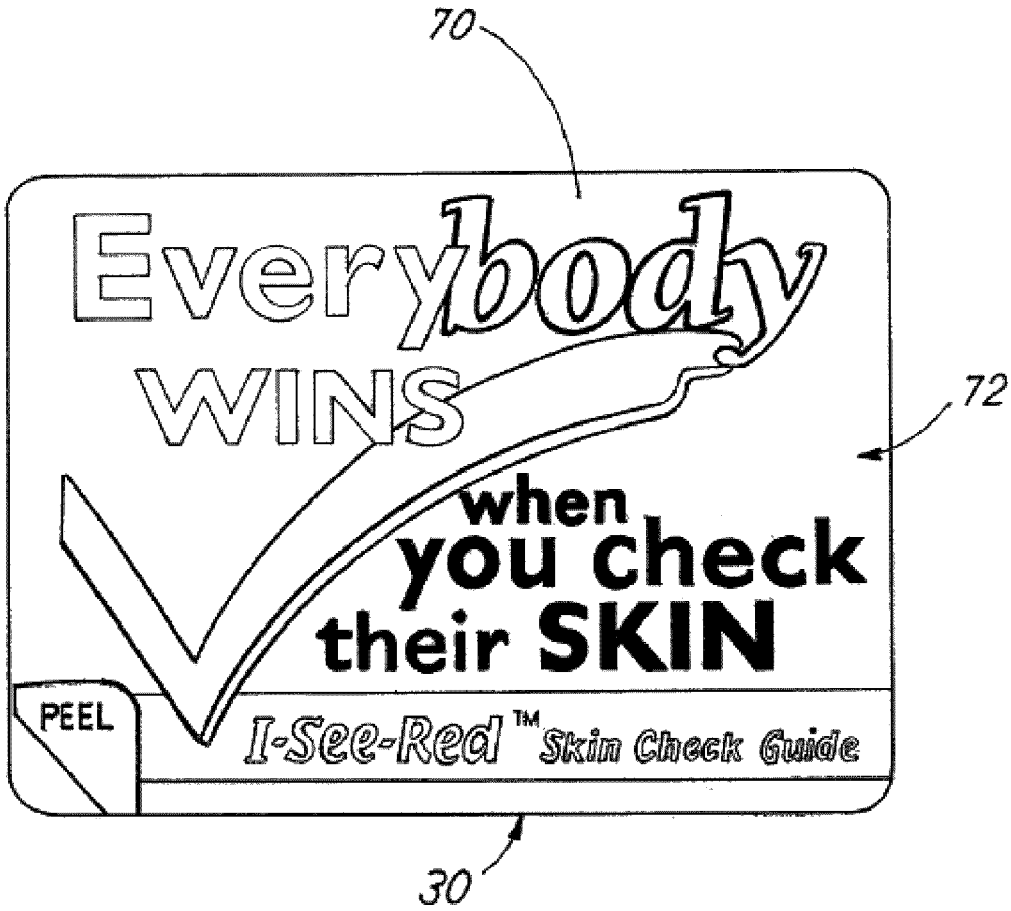
FIG. 4 illustrates an exemplary embodiment of a second side of a label according to an aspect of the present invention.

FIG. 4 illustrates an exemplary embodiment of the second side 70 of the label 30 including a marketing graphic 72. The marketing graphic may be a configured as desired. For example, the marketing graphic 72 may be a variety of different shapes and/or colors and may include trademarks and/or descriptive terms. As can be appreciated, the ability to provide a marketing graphic 72 can significantly boost the visual appeal of the health care supplies assembly 10. The marketing graphic 72 may also allow, for example, care providers to quickly recognize the health care supplies in the container 20 with a glance, thus allowing the care provider to concentrate on other matters instead of having to determine whether the appropriate health care supplies are present for the intended treatment.

Furthermore, the marketing graphic 72 in some embodiments may provide simple instructions or some type of reminder that help to ensure the care provider does not omit a step during the provision of health care. The marketing graphic 72 in some embodiments can be useful in helping to ensure the care provider does not forget to do certain steps that are important for the health of the patient. In an embodiment, the marketing graphic 72 may promote the template 62. For example, the marketing graphic 72 might include a phrase such as "I SEE RED"™ that reminds the care provider to check the skin condition of the patient. Instruction for use of the label or product may be placed on the side of the label with the template and may also be placed on or off the template.

Thus, the label 30 may include the template 62 on the first side 60 of the label, the template 62 mounted face down, and may also include the marketing graphic 72 on the second side 70. In addition, the label 30 may occlude the opening 40 and may even seal the container 20 if the opening 40 is an actual opening (FIG. 1). Such a configuration maximizes the use of the label 30 and helps to minimize the costs of the health care supplies assembly 10.

In an embodiment, the label 50 (FIG. 2) includes the template 62 on the first side 60 and may include the marketing graphic 72 on the second side 70. This allows for the removal of the label 50 without breaching or opening the container 20. In an embodiment, the template 62 is substantially not visible when placed on the container 20 face down.

Figure 5:
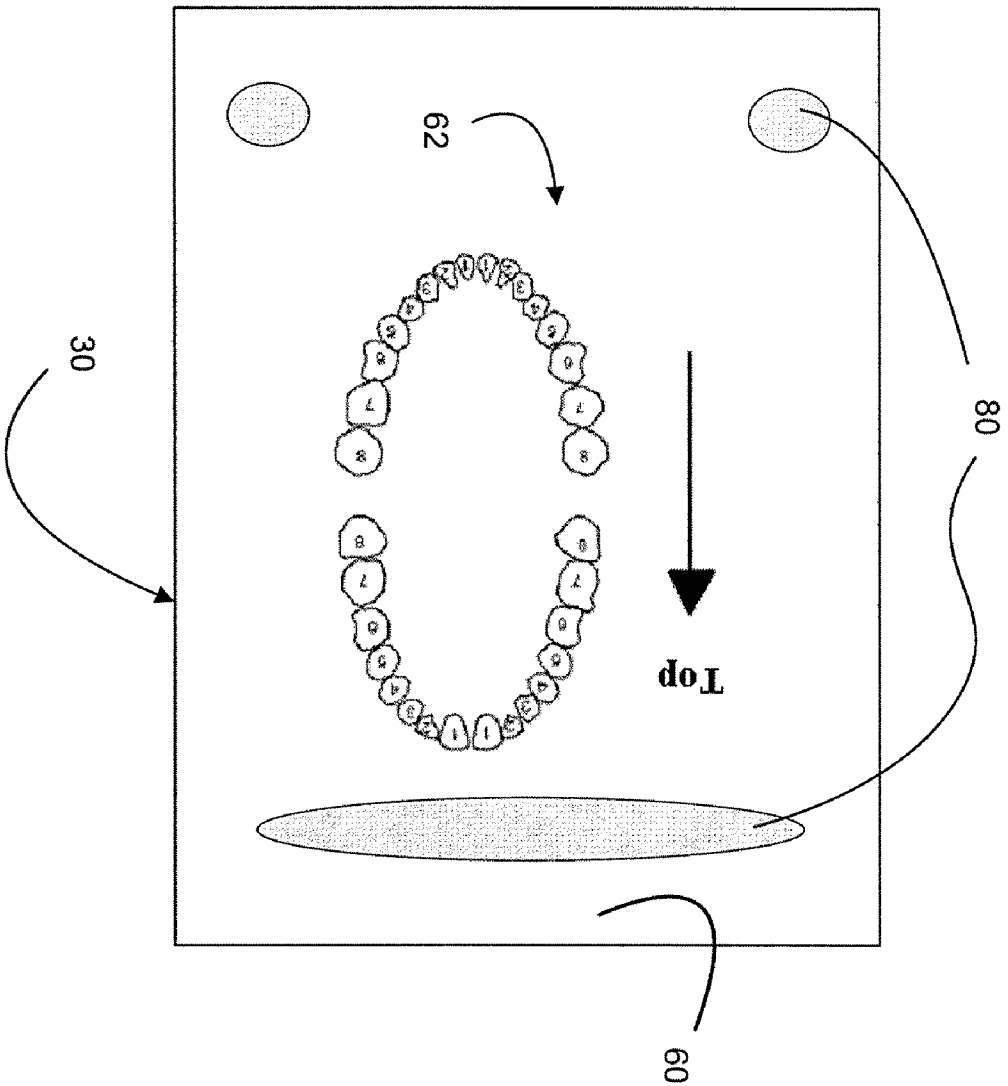
FIG. 5 illustrates an alternative exemplary embodiment of a first side of a label according to an aspect of the present invention.

Turning to FIG. 5, the label 30 is shown with an alternative exemplary embodiment of the template 62 and may include one or more adhesive areas 80 on the first side 60. If provided, the adhesive area 80 allows the label 30 to be attached to a medical chart, such as is typically used for the patient. The adhesive area 80 may be configured so as to allow the label to be removable mounted to the medical chart or it may be configured so as to allow the label 30 to be permanently mounted to the medical chart. For example, the adhesive area may be a pressure sensitive adhesive. The label 50 may also be so configured similarly. In addition, the adhesive area 80 may be used to attach the labels 30, 50 to the container 20 or to each other. Furthermore, an adhesive area 80 may also be placed on the second side 70. In an embodiment, the second side 70 may include the adhesive area 80 with the adhesive area 80 being covered by a removable shield (not shown). The template on label 30, in an embodiment, depicts a portion of care a recipient's mouth. Markings can be made on this template to note areas of concern observed while attending to oral hygiene of a care recipient.

Figure 6:
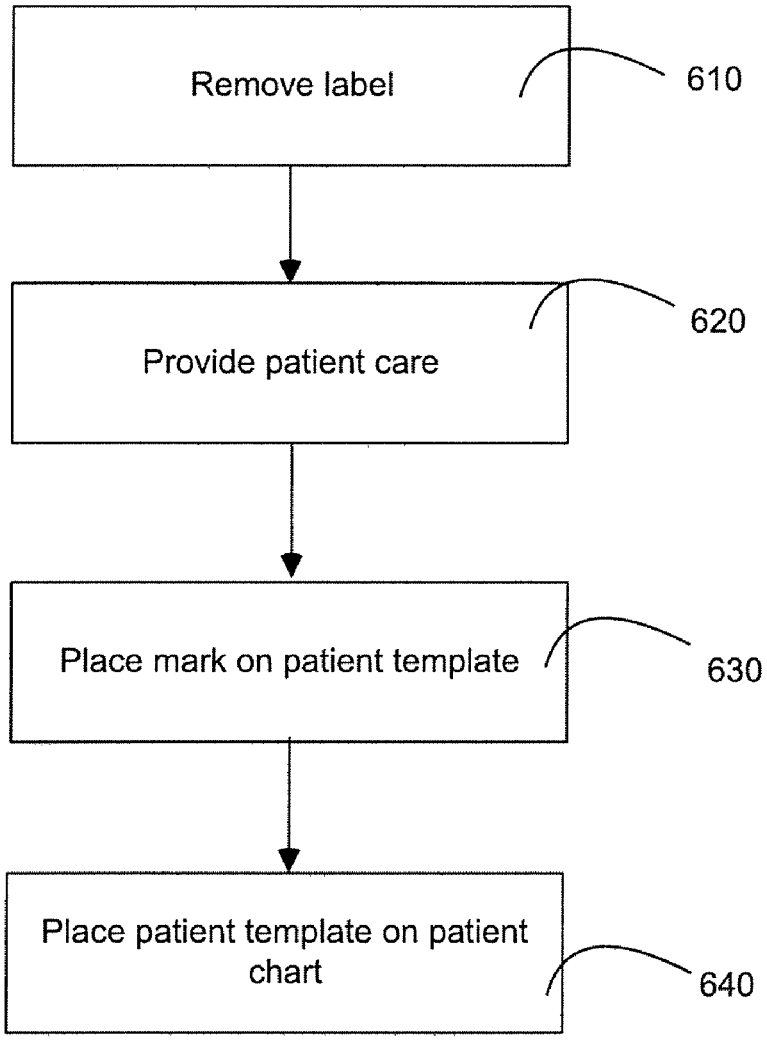
FIG. 6 illustrates a method of using a health care supplies assembly according to an aspect of the present invention.

Turning to FIG. 6, an illustration of a method of using the label 30 is provided. First, in step 610 the label with the template is removed from the container 20. The label being removed may be the label 30 or the label 50 or may be both labels 30, 50. The latter situation may occur if, for example, the label 50 is attached to the label 30 and thus the label 50 is indirectly mounted to the container 20. In an embodiment, the label being removed will allow the container 20 to be opened.

Next in step 620, the health care supplies within the container 20 are used to provide the patient care. Naturally, if the removal of the label did not cause the container 20 to be opened then the container 20 will need to be opened before the patient care supplies may be accessed. In an embodiment, opening of the container may be accomplished by exerting a force on the edge 42.

Next, in step 630 the care provider may mark the template 62 if something of interest is observed during the process of providing the patient care. Then, in step 640, the label with the marked template 62 is placed on the patient's medical chart. The label with the template 62 may also placed on the medical chart first before the template is marked. Thus, step 640 may be done before step 630 or even before step 620. If the care provider only places the label with the template 62 on the patient's chart when a potential medical issue is observed, then it may be better to wait to place the label with the template 62 on the patient's medical chart after the condition is observed, if at all. However, if the adhesive area 80 provided on the label allows the label to be removably mounted to the patient's chart, it may be preferable to place the label on the medical chart first so that the label is not accidentally misplaced during the provision of health care. In an embodiment, step 640 involves direct hand-off of the label to a second care provider or nurse and does not involve placement on a medical chart. In another embodiment, step 640 involves placement of the label in a staging area for later retrieval by a second care provider or other individual.

Figure 7:
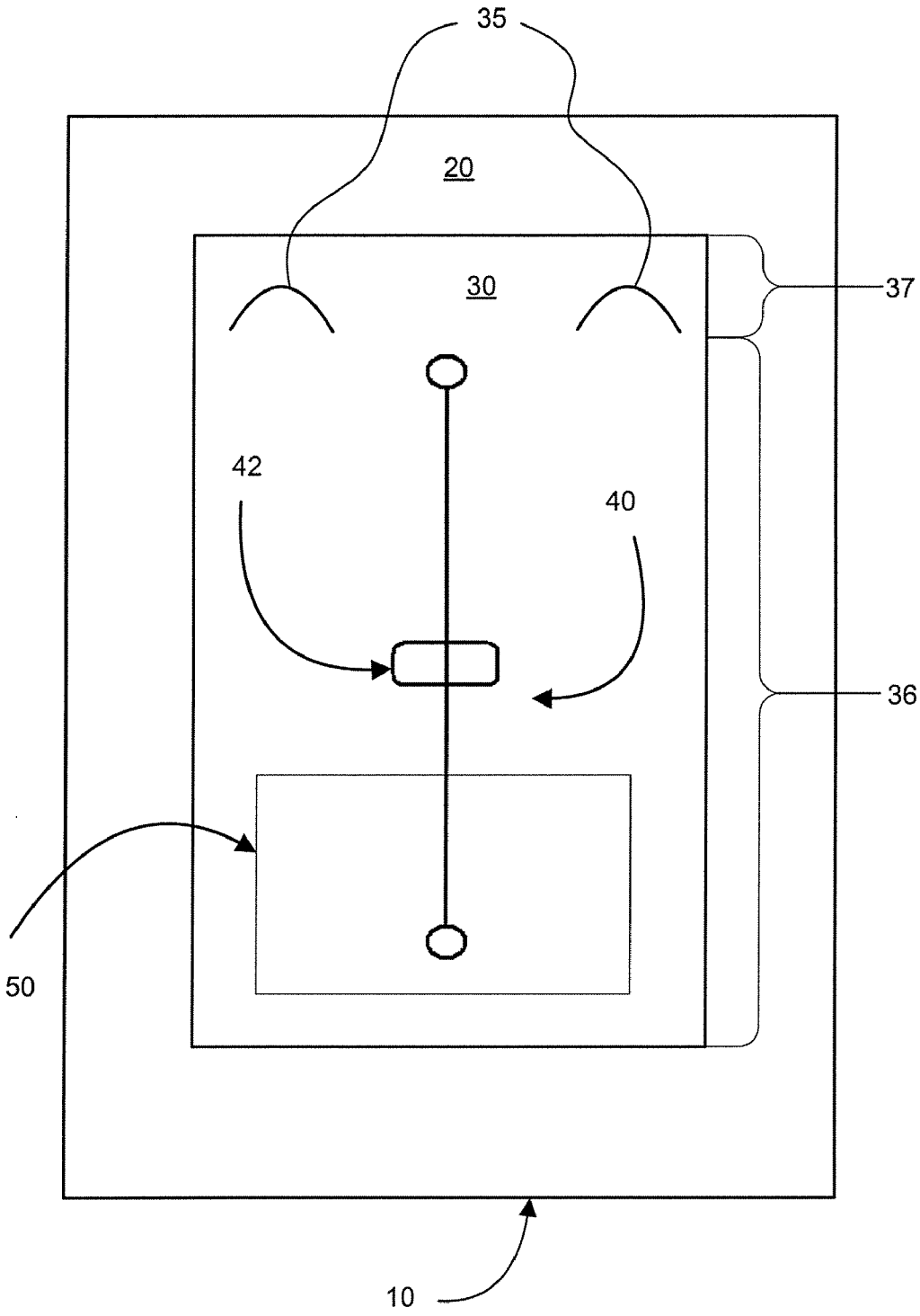
FIG. 7 illustrates an alternative exemplary embodiment of a health care supplies assembly according to an aspect of the present invention.

Turning next to FIG. 7, an exemplary embodiment of an alternative arrangement of the container 20 is depicted. The container 20 includes the label 30 that covers the opening 40. As can be appreciated, the edge 42 of opening 40 extends a significant portion of the length of the container 20. In an exemplary embodiment, the edge 42 would not be visible because the label 30 would occlude the edge 42 from view. For purposes of illustration, however, the label 30 and label 50 are depicted as transparent.

In an embodiment, the opening 40 of the container 20 is not actually open but merely has the edge 42 formed into the container 20. When the label 30 is removed, the edge 42 can be accessed by the user and through the application of force, the container 20 may be opened along the edge 42. The removal of the label 30 may also cause the edge 42 to separate and form the opening 40. The resultant opening 40 allows the user to access the health care supplies within the container 20.

The label 50 also is mounted on the container 20. The label 50 may be mounted to the container 20 indirectly by being attached to the label 30 rather than being directly mounted on the container 20. Thus, the label 30 may be removed and the health care supplies can be used.

The label 30 can be partially removed from the container 20 or fully removed from the container 20. In an embodiment, edges 35 can be included in label 30. The edges 35 may inhibit label 30 from being completely removed from the container 20. The portion of label 30 generally indicated by 36 can be more easily removed from the container. The portion of label 30 generally indicated by 37 can be less easily removed from the container.

The label 30 can be re-mounted to container 20. In an embodiment, the label can be partially removed from the container 20, supplies can be removed and the label 30 re-mounted to container 20, thereby resealing the container. If the care provider notices something of interest, the label 50 may be removed and an indicator mark may be placed on a template that is on the label 50. The label 50 does not have to be removed unless the care provider wants to place an indicator mark on the template. The label 50 can remain attached to label 30 while label 30 is at least partially removed from container 20. To assist the care provider in remembering to check for the medical condition relevant to the template, the label 50 may include the marketing graphic discussed above.

Figure 8:
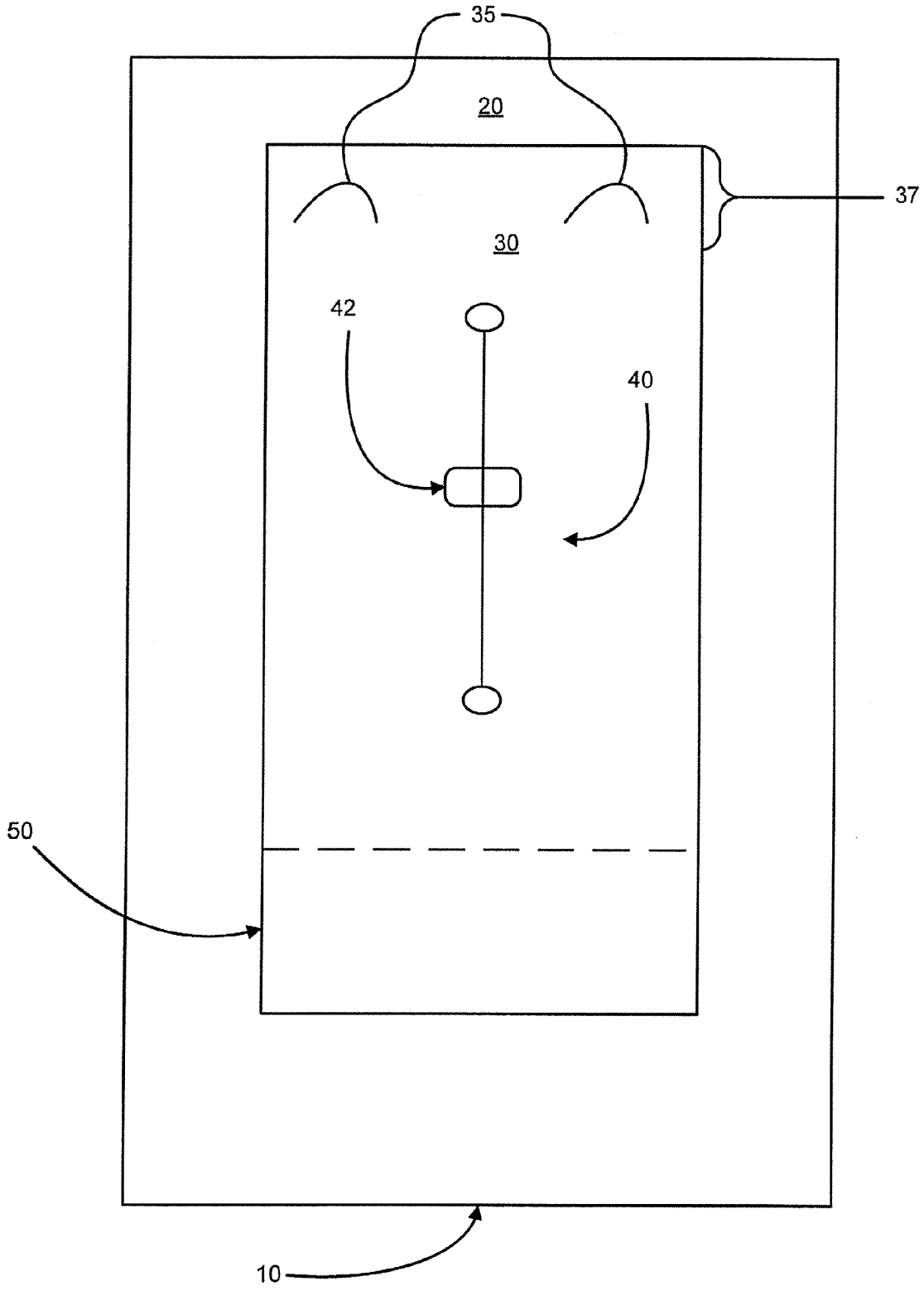
FIG. 8 illustrates a further alternative exemplary embodiment of a health care supplies assembly according to an aspect of the present invention.

Turning next to FIG. 8, an exemplary embodiment of an alternative arrangement of the container 20 is depicted. The container 20 includes label 30 that covers the opening 40 and label 50. Label 30 and label 50 form part of the same label. The boundary between label 30 and label 50 (marked by a dotted line) is perforated, and allows label 50 to be detached from label 30 by means of the application of force. In the course of opening the container 20, the care provider grasps and removes the detachable label 50 from label 30. Label 50 and template 62 are thus brought to the attention of the care provider, reminding staff of the need to inspect and report on the patient and to mark areas of concern, if any, on template 62. The positioning of detachable label 50 increases the likelihood of care givers adopting regular and clinically desirable patient inspection and reporting routines. Care givers are more likely to report skin condition to staff, even where there are no areas of concern. In the exemplary embodiment, label 50 does not form part of the label 30 that is responsible for sealing the container and therefore the container 20 may be resealed if supplies within the container are not exhausted and can be reused.

In another embodiment, label 50 may serve as part of the covering of the container 20 that is responsible for sealing the container. This embodiment may be useful in circumstances where supplies in the container are not intended to be reused once the container is breached. The caregiver detaches label 50 from the covering in the process of opening the container 20, and uses it for reporting on the patient's skin condition. After label 50 has been detached from the container, the remainder of the covering may be configured such that it is insufficient to reseal the container, thus preventing the caregiver from resealing supplies in container 20 that are not intended to be reused.

As can be appreciated in light of the above discussion, the label 50 could also be removed first and mounted on the patient's chart with the template 62 facing up. In an embodiment, the mounting may be removable. The label 30 would then be removed and the health care supplies within the container 20 would be used to provide the health care. Observations of conditions or medical symptoms could be marked on the template 62 and if no symptoms were observed, then the label 50 could be removed from the patient's chart.

In an embodiment, the template 62 can be configured to allow for universal communication through symbols. For example, a care provider could simply place a symbol, such as a circle, a check, an "X" or other mark on the template 62 depicted in FIG. 3 to indicate where a potential skin issue was noted. This flexibility minimizes the potential for language barriers preventing proper communication regarding medical conditions observed by the care provider. The use of a non-word symbol may further facilitate universal communication. Moreover, different symbols could have different meanings, such as indicating a different level of severity. The use of a non-word symbol also has the benefit of allowing a second care provider to very quickly determine where to look to evaluate the potential medical condition. Thus, aspects of the present invention may provide significant improvements to the well being of the patient while saving medical personnel valuable time.

In an embodiment, label 50 is placed inside of the container 20 and is not placed on the outside of the container 20. The label 50 is not accessible until the container 20 is opened. The label 50 may be placed on top of the medical supplies before the container 20 is initially closed. When the medical supplies are opened by the care provider, the label 50 is removed from the interior of the container 20 by the care provider. The label 50 can include the template 62 and the marketing graphic 72. The label 50 may also include instructions for use of the template 62. In an embodiment, instructions for use of the template 62 are on the same side of the label as the template.

In another embodiment, label 50 is provided as a stand-alone device. The label does not accompany another product but is provided independently of other products. In an embodiment, the label 50 is used with a basin bath or sponge bath. The label 50 also can be used with other care procedures such as those described above. A basin bath or sponge bath may include the use of a cleanser, including soap and/or shampoo. The label contains a template that is an aid in recording information about a patient's condition. As a care provider is providing care, through, e.g., a basin bath or sponge bath, the care provider can note any issues regarding skin condition on the template of the label. The label can be provided with standard items used in a basin bath (such as cleanser or shampoo) or the label can be provided independently. The care provider can then transmit the template (through manual, electronic or other known means of such transmission) to a second care provider either directly or indirectly. Such transmission assists in assuring that accurate information concerning a patient's condition is not lost.

The present invention has been described in terms of preferred and illustrative embodiments thereof. Numerous other embodiments, modifications and variations within the scope and spirit of the appended claims will occur to persons of ordinary skill in the art from a review of this disclosure.

We claim:

1. A medical diagnostic aid comprising: a container; a plurality of washcloths provided within the container; a covering mounted on the container; and a diagnostic label removably mounted on the container, the diagnostic label incorporating a diagnostic template and defining a first side and a second side, the diagnostic label removable from the covering, wherein the diagnostic label can be completely removed from the container without causing the container to be opened, wherein the diagnostic template comprises at least one graphic depiction of at least a portion of the human body, the graphic depiction comprising discrete, independent areas configured to enable the diagnostic template to be marked to indicate areas of potential medical concern on a human's body, and wherein the diagnostic label further comprises at least one adhesive area configured to allow the diagnostic label to be removed from the container and remounted to the container or mounted to a patient record or handed off to a care provider or placed in a staging area for later recovery by a care provider.

2. The medical diagnostic aid of claim 1, wherein the diagnostic template is on the first side of the diagnostic label, and the diagnostic template is generally not visible from the second side of the diagnostic label.

3. The medical diagnostic aid of claim 2, wherein the diagnostic label further comprises instructions for use of the diagnostic template.

4. The system of claim 1, wherein the diagnostic label is mounted directly on the container.

5. The system of claim 4 further comprising a plurality of diagnostic labels detachable from the covering.

6. The medical diagnostic aid of claim 4 wherein the diagnostic label is mounted to the covering.

7. The medical diagnostic aid of claim 1 wherein the washcloths comprise disposable washcloths and include an effective amount of a cleaning solution, the cleaning solution configured to absorb microwave radiation.

8. A medical diagnostic system useful in cleansing and checking a patient, the system comprising: a container, the container including an entry; a cleansing product designed to cleanse at least a portion of the patient, the cleansing product positioned within the container; a first label mounted to the container, the first label covering the entry to the container; and a second label mounted on the container and comprising a first side and a second side, the first side comprising a diagnostic template, the diagnostic template comprising a graphic depiction of at least a portion of the patient's anatomy, wherein the graphic depiction of at least a portion of the patient's anatomy includes a plurality of discrete, independent marking areas configured to allow a care provider to mark a notation on the graphic depiction corresponding to an observed area of concern on a patient's anatomy, and wherein the second label further comprises at least one adhesive area configured to allow the second label to be removed from the container and reattached to the container or attached to a patient record or handed off to a care provider or placed in a staging area for later recovery by a care provider.

9. The medical diagnostic system of claim 8, wherein the second label is removable from the system without breaching the container, and wherein the container, once opened, is resealable.

10. The medical diagnostic system of claim 9, wherein the diagnostic template generally is not visible from the second side.

11. A medical diagnostic system comprising: a container, wherein a surface of the container defines a container entry; a plurality of washcloths provided within the container; a first label and a second label; wherein the first label covers the container entry and the second label incorporates a diagnostic template that depicts at least a portion of a human body on a first side of the second label that generally is not visible from a second side of the second label and wherein the second label is removable from the container without breaching the container, wherein the diagnostic template depicting at least a portion of a human body includes a plurality of discrete, independent marking areas configured to allow a care provider to mark a notation on the diagnostic template corresponding to an observed area of concern on a human's body, and wherein the second label further comprises at least one adhesive area configured to allow the second label to be removed from the container and remounted to the container or mounted to a patient record or handed off to a care provider or placed in a staging area for later recovery by a care provider.

12. The medical diagnostic system of claim 8, wherein the cleansing product is a plurality of disposable washcloths.

13. The medical diagnostic system of claim 11, wherein the diagnostic template depicts at least a portion of the human mouth.

14. The medical diagnostic system of claim 11, wherein the second label is mounted to the first label.

* * * * *